US009647392B2

(12) United States Patent
Lapidot et al.

(10) Patent No.: US 9,647,392 B2
(45) Date of Patent: May 9, 2017

(54) RF CONNECTOR

(71) Applicants: Tyco Electronics (Shanghai) Co. Ltd., Shanghai (CN); Tyco Electronics Japan G.K., Kanagawa (JP)

(72) Inventors: Doron Lapidot, Tokyo (JP); Masayuki Aizawa, Tokyo (JP); Anson Ma, Shanghai (CN)

(73) Assignees: Tyco Electronics Japan G.K., Kanagawa-ken (JP); Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/617,446

(22) Filed: Feb. 9, 2015

(65) Prior Publication Data

US 2015/0155660 A1 Jun. 4, 2015

Related U.S. Application Data

(63) Continuation of application No. PCT/IB2013/056440, filed on Aug. 6, 2013.

(30) Foreign Application Priority Data

Aug. 9, 2012 (CN) ..... 2012 1 0283124

(51) Int. Cl.
*H01R 13/646* (2011.01)
*H01R 12/57* (2011.01)

(52) U.S. Cl.
CPC ..... *H01R 13/646* (2013.01); *H01R 12/57* (2013.01)

(58) Field of Classification Search
CPC ..... H01R 13/646; H01R 12/57
USPC ..... 333/33
See application file for complete search history.

(56) References Cited

U.S. PATENT DOCUMENTS 4,964,805 A 10/1990 Gabany
6,079,986 A * 6/2000 Beshears ..... H01R 9/096 439/581
2003/0052755 A1 3/2003 Barnes et al.
2012/0056696 A1 3/2012 Cheng et al.

FOREIGN PATENT DOCUMENTS

JP 2005-26021 A 1/2005

OTHER PUBLICATIONS

PCT Search Report and Written Opinion issued in co-pending International Application PCT/IB2013/056440, dated Dec. 13, 2013, 10 pages.
Abstract for JP2005026021, dated Jan. 27, 2005, 2 pages.
PCT International Preliminary Report on Patentability and Written Opinion of the International Searching Authority, International Application No. PCT/IB2013/056440, dated Feb. 10, 2015, 5 pages.

* cited by examiner

*Primary Examiner* — Stephen E Jones
*Assistant Examiner* — Scott S Outten
(74) *Attorney, Agent, or Firm* — Barley Snyder

(57) ABSTRACT

A connector for surface mounting to a circuit substrate is disclosed having an insulator, a center conductor mounted to the insulator; and a shielding shell externally mounted on the insulator. The shielding shell has a connecting portion and a mounting portion. The mounting portion has a connector mounting body with a shielding portion, a fluid communication well, and at least one opening. A plurality of solder legs are formed on the connector mounting body.

15 Claims, 7 Drawing Sheets

RF CONNECTOR

CROSS-REFERENCE TO RELATED APPLICATIONS

This application is a continuation of PCT International application no. PCT/IB2013/056440, dated Aug. 6, 2013, which claims priority under 35 U.S.C. §119 to Chinese Patent Application No. 201210283124, dated Aug. 9, 2012.

FIELD OF THE INVENTION

The present invention is generally related to an electrical connector and more specifically, to a Radio Frequency connector.

BACKGROUND

A Radio Frequency ("RF") connector is an electrical connector designed to work at radio frequencies. RF connectors are typically used with coaxial cables and are designed to maintain the shielding that the coaxial cable offers.

FIG. 1*a*, 1*b* and 1*c* illustrate a conventional surface-mounted RF connector 100. The conventional RF connector 100 generally has a center conductor 110, an insulator 120, a shielding shell 130, and a connector body 132. The shielding shell 130 is externally mounted on the insulator 120, and the center conductor 110 is partially inserted into a central insertion bore of the shielding shell, through a conductor receiving passageway formed on a mating end of the shielding shell 130.

Generally, the RF connector 100 is surface-mounted on a circuit substrate such as a printed circuit board ("PCB") 200 (See FIG. 2) via the center conductor 110 and four solder legs 131. More specifically, the four solder legs 131 are soldered into the corresponding solder leg receiving holes 250 disposed in the printed circuit board 200. The center conductor 110 is soldered to a corresponding solder pad 240 in the center of the printed circuit board 200 via a cylindrical shaped solder terminal.

The connector body 132, center conductor 110, air between the body 132 and an exposed soldering tip 111 of the center conductor 110 together form a coaxial structure, which has a characteristic impedance higher than 50 Ohm. This impendence discontinuity often causes big reflections on signal transmission. As a result, the voltage standing wave ratio ("VSWR") will be high, especially at a higher working frequencies. Therefore, as shown in FIG. 1*c*, the characteristic impedance of the conventional RF connector is not continuous, because a transition portion 104 of the traditional RF connector 100 has a higher characteristic impedance than other portions of the RF connector 100.

Consequently, the signals transmitted between the conventional RF connector 100 and the PCB 200 are poorly shielded as opposed to the coaxial cable, which would adversely affect the impedance continuity at the center conductor 110.

There is a need for an improved shielding shell to form a better coaxial structure, so as to improve the VSWR of transmitted signals.

SUMMARY

A connector for surface mounting to a circuit substrate has an insulator, a center conductor mounted to the insulator, and a shielding shell externally mounted on the insulator. The shielding shell has a connecting portion and a mounting portion. The mounting portion has a connector mounting body with a shielding portion, a fluid communication well, and at least one opening. A plurality of solder legs are formed on the connector mounting body.

BRIEF DESCRIPTION OF THE DRAWINGS

The invention will now be described by way of example, with reference to the accompanying Figures, of which.

DETAILED DESCRIPTION OF THE PREFERRED EMBODIMENT(S)

While the invention will herein be described in terms of exemplary embodiments, with reference to FIGS. 3-7, one of ordinary skill in the art would understand that the exemplary embodiments illustrate the principles of the invention, and are not intended to limiting.

Figure 3:
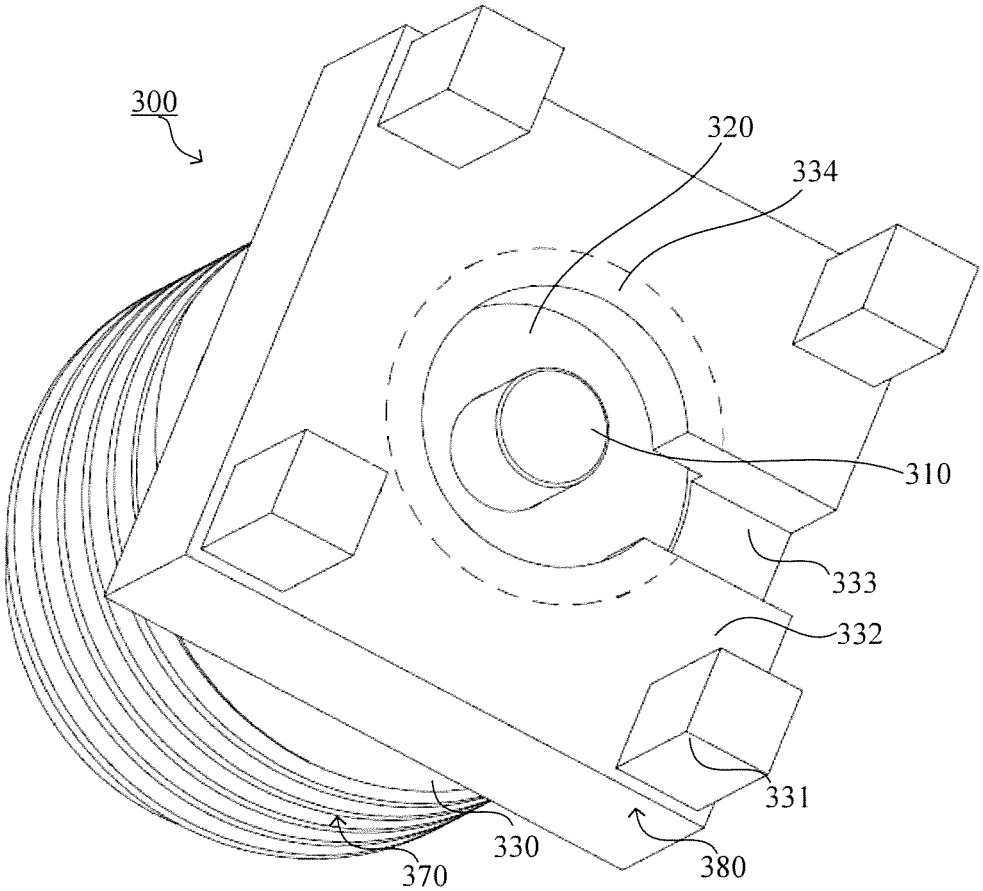
FIG. 3 is a perspective mating end view of an RF connector.

In an embodiment of FIG. 3, an RF connector 300 has an insulator (not shown), a shielding shell 330 with a connecting portion 370 for connecting the RF connector with another mating connector (not shown) and a mounting portion 380 configured to be mounted to a circuit substrate (not shown). The shielding shell 330 is externally mounted over the insulator. The mounting portion 380 has a connector mounting body 332 and four solder legs 331 formed on a mounting end of the connector mounting body 332. The solder legs 331 are to be soldered to corresponding solder pads on the circuit substrate (not shown).

The connector mounting body 332 has a shielding portion 334, shown in an embodiment of FIG. 3 as a circle with dashed line, surrounding an extending portion of a center conductor 310, so as to improve the shielding of the signal transmitted between the RF connector 300 and the circuit substrate. In an embodiment, an internal surface of the shielding portion 334 is annular, and surrounds the extending portion of the center conductor 310. In an embodiment, an internal surface diameter of the shielding portion 334 is in a range of approximately 2.80 to 3.10 mm. In an embodiment, the internal surface diameter of the shielding portion 334 is approximately 3.00 mm. An annular fluid communication well 320 is recessed in the mounting end of the connector mounting body 332, surrounding and separating the center conductor 310 from the shielding portion 334. The center conductor 310 is partially received the RF connector 300 on the mounting end, with the extending portion extending outward in the same direction as the soldering legs 331, and an opposite embedded portion (not shown) being mounted to the insulator.

The mounting portion 380 also has at least one opening 333 enlarging the fluid communication well 320 between the extending portion of center conductor 310 and the shielding portion 334 with outside space of the RF connector when the RF connector 300 is soldered to a circuit substrate. In an embodiment, the opening 333 is connected to the fluid communication well 320 on a first end, with an opposite second end terminating in outside space, such that the fluid communication well has fluid communication with the outside space. In an embodiment, the internal diameter of the shielding portion is approximately 3.0 mm, being adapted for receiving a portion of the corresponding center conductor. When the diameters of the shielding portion 334 and the center conductor 310 are suitable for each other, the return loss of the signal transmitted between them can be maximal reduced.

Figure 4:
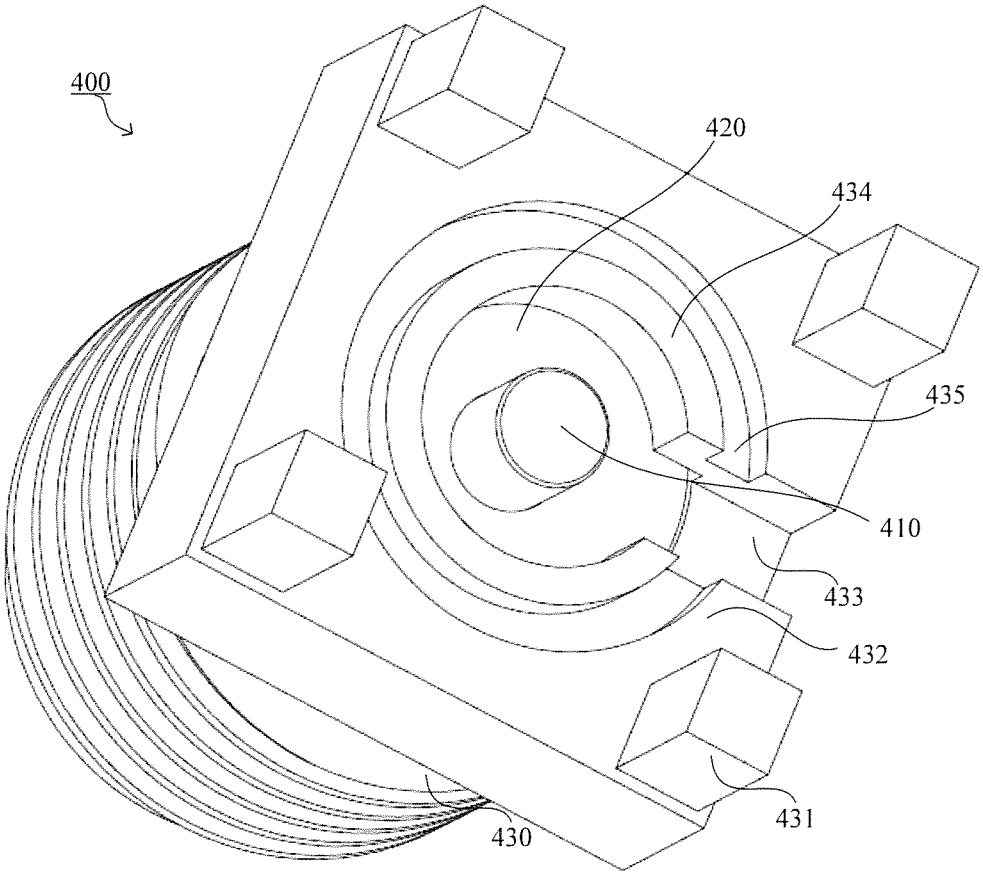
FIG. 4 is a perspective mating end view of an RF connector.

In an embodiment of FIG. 4, an RF connector 400 is substantially similar to the RF connector 300, with discussion of similar elements being omitted for clarity. The RF connector 400 includes a shielding shell 430 and a connector mounting body 432 having a groove 435 disposed thereon. The connector mounting body 432 further includes four solder legs 431 substantially the same as the solder legs 331, being formed on a mounting end of the connector mounting body 432. The groove 435 is positioned adjacent to a shielding portion 434. In an embodiment, an external surface of the shielding portion 434 is defined by the groove 435, with the groove 435 extending circumferentially around the shielding portion 434. An annular fluid communication well 420, substantially similar to the fluid communication well 320, is recessed in the mounting end of the connector mounting body 432, surrounding and separating the center conductor 410 from the shielding portion 434. In an embodiment, the groove 435 has a width and depth of approximately 0.5 mm. The groove 435 is in fluid communication with an opening 433 recessed in the mounting end of the connector mounting body 432, when the RF connector 400 is soldered to a circuit substrate. Together with the groove 435 and opening 433, a fluid communication well 420, substantially similar to the fluid communication well 320, is enlarged. Thus the soldering of the shielding portion 434 with the corresponding solder pad on the circuit substrate is improved, providing an improved shielding and shielding effect.

Figure 5:
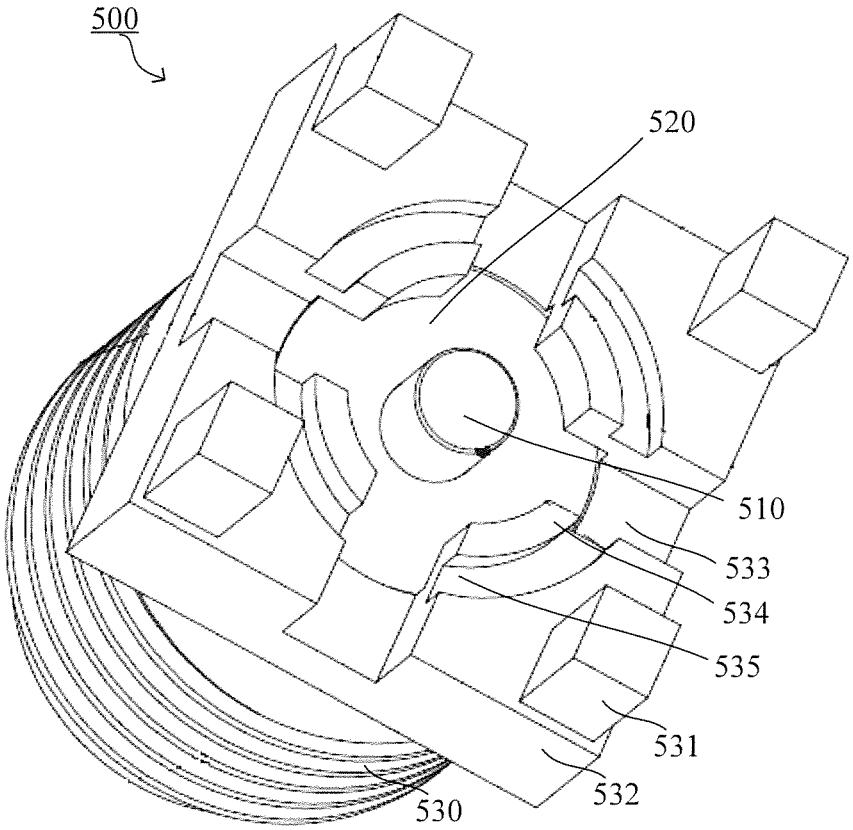
FIG. 5 is a perspective mating end view of an RF connector.

In an embodiment of FIG. 5, an RF connector 500 is substantially similar to the RF connectors 300,400, with discussion of similar elements being omitted for clarity. The RF connector 500 has a shielding shell 530, and a connector mounting body 532 having a plurality of openings 533 recessed in the mounting end of the connector mounting body 532. In an embodiment, the connector mounting body 532 is formed in an approximate square shape. The plurality of openings 533 provide an enlarged fluid communication space 520, between the extending portion of the center conductor 510 and a shielding portion 534, further providing improved thermal relief during soldering of the RF connector 500 to the circuit substrate. In an embodiment, the connector mounting body 532 has four openings 533 respectively positioned in an approximate middle of each edge of the square connector mounting body 532. A groove 535, substantially similar to the groove 435 is positioned adjacent to an external mounting end surface of a shielding portion 534.

The connector mounting body 532 further includes four solder legs 531 substantially the same as the solder legs 331,431, formed on a mounting end of the connector mounting body 532. Thus the soldering quality between the shielding portion 534 and the corresponding solder pads is improved. Accordingly, the VSWR of the RF connector 500 is improved.

Figure 1A:
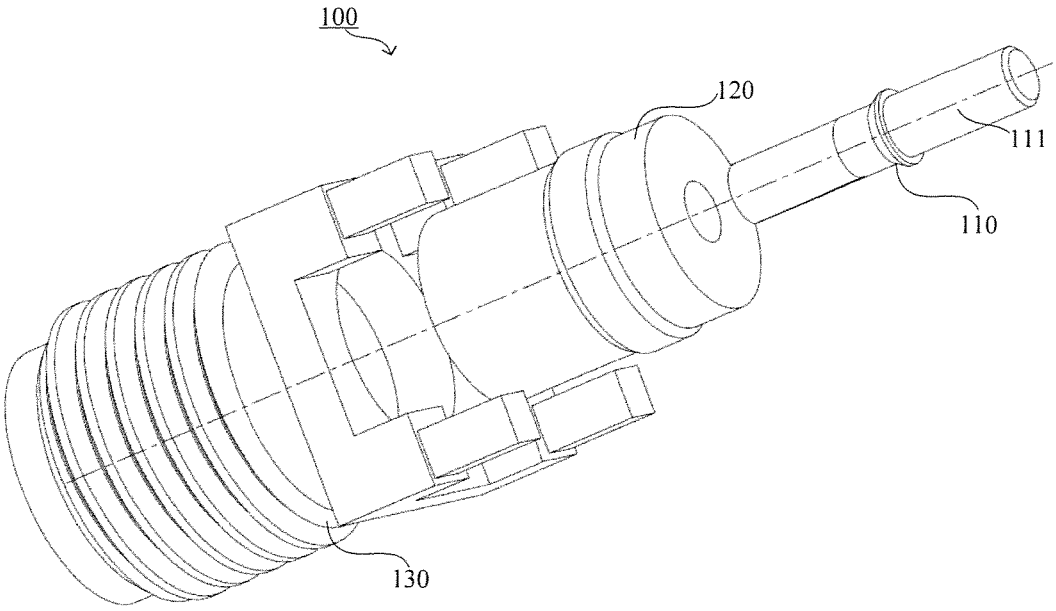
FIG. 1*a* is an exploded view of a conventional RF connector.
Figure 1B:
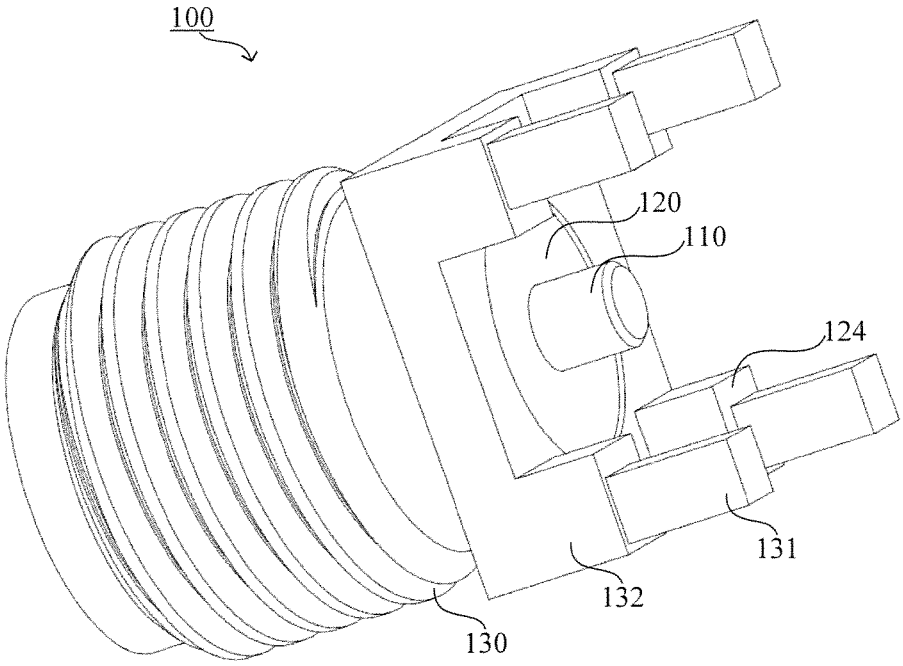
FIG. 1*b* is a perspective view of the conventional RF connector.
Figure 1C:
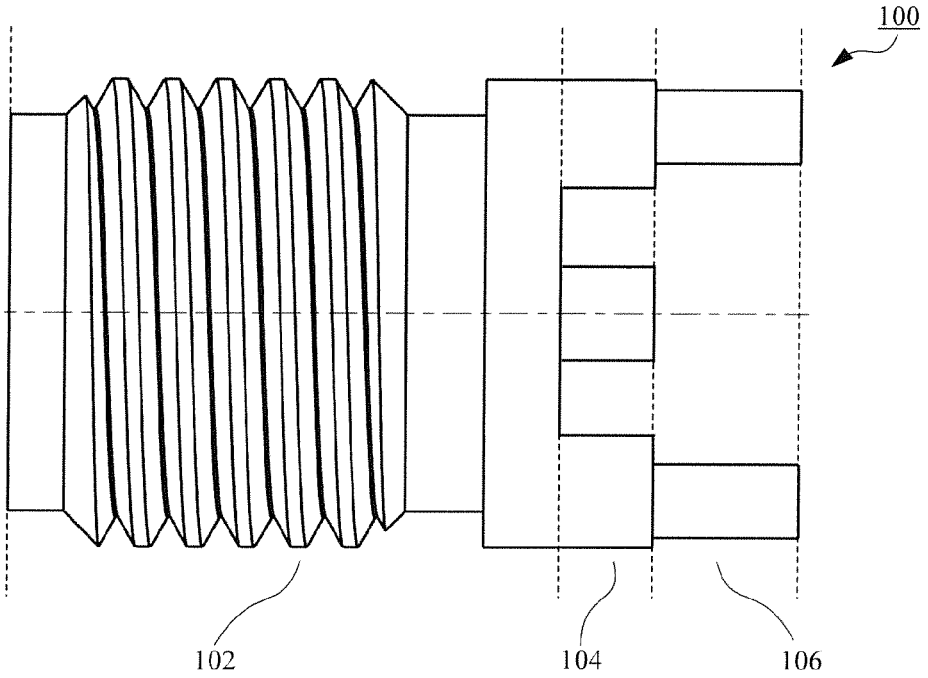
FIG. 1*c* is a side view of the conventional RF connector.
Figure 2:
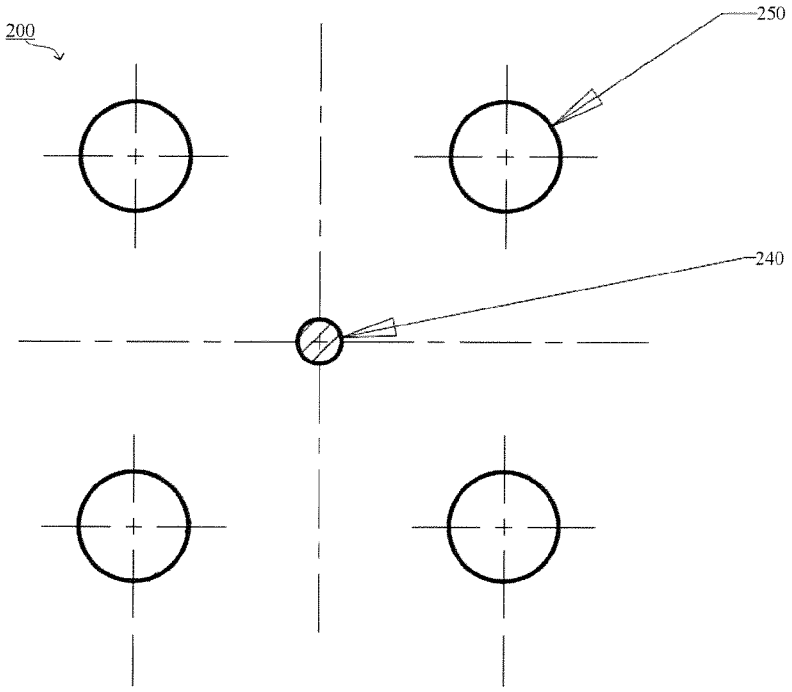
FIG. 2 is a corresponding PCB layout for the conventional RF connector.
Figure 6:
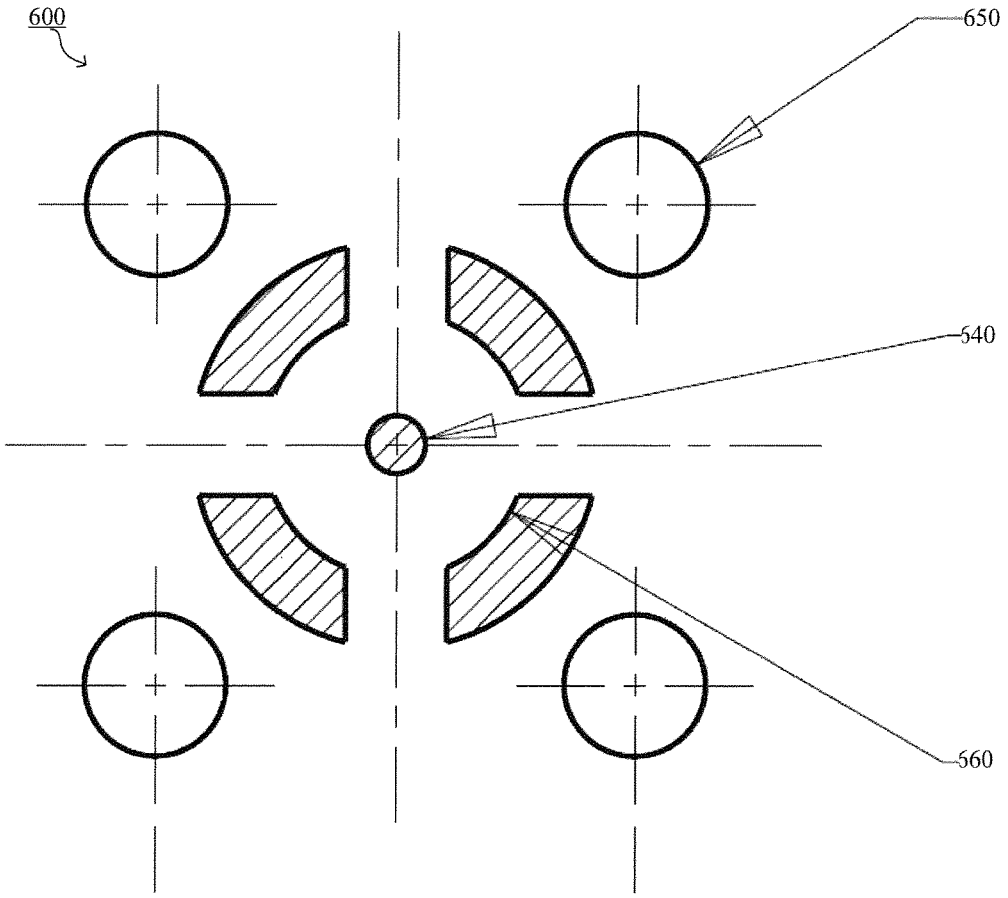
FIG. 6 is a corresponding PCB Layout for the RF connector of FIG. 5.

In an embodiment of FIG. 6, a corresponding PCB Layout for the RF connector 500 is shown. Compared with the PCB Layout in FIG. 2 for the conventional RF connector 100, in addition to the four solder pads 650 corresponding to the four solder legs 531, there are four additional solder pads 660 on this PCB Layout. These four additional solder pads 660 are to be soldered with the complementary segmented shielding portion 534 of the shielding shell 530, so as to provide improved shielding. Further, a center conductor receiving pad 640 is shown for clarity.

Since the RF connectors 300,400,500 disclosed above provide improved shielding for the extending portion of the center conductor 310,410,510, the return loss even at the extending portion is reduced and thus the impedance continuity of the RF connector is improved, which is advantageous in the high-frequency range. Accordingly, it is possible to significantly improve the high-frequency characteristic (VSWR). Further, it is possible to enable the use of the RF connector 300,400,500 disclosed herein in higher-frequency ranges (for example 20 GHz) than that of the conventional RF connector 100.

Figure 7:
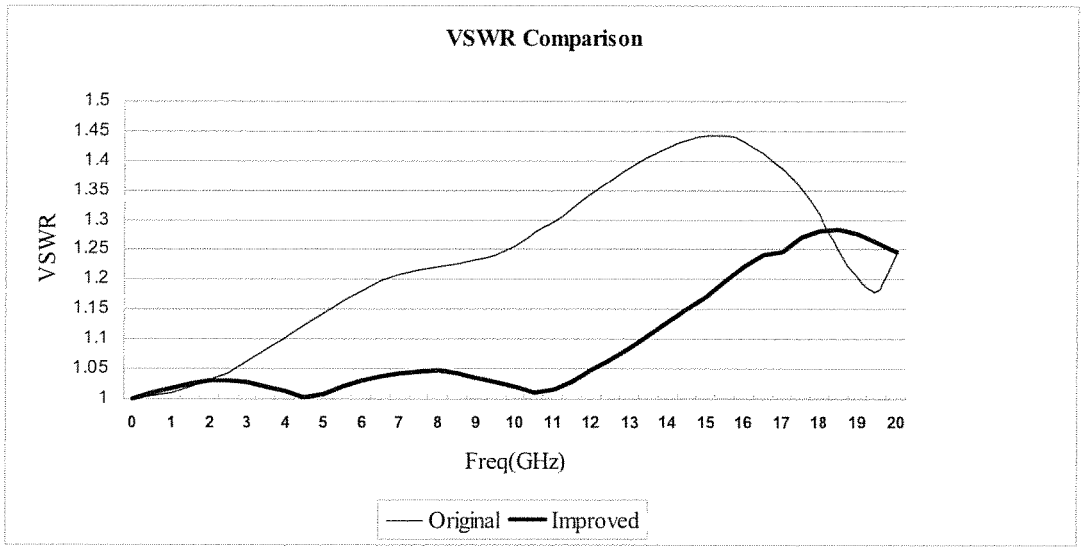
FIG. 7 is a plot of VSWR curves of the conventional RF connector of FIG. 1*b* against the RF connector of FIG. 5.

In an embodiment of FIG. 7, VSWR curves of the conventional RF connector 100 are plotted against the RF connector 500. Those of ordinary skill in the art would appreciate that VSWR is an important feature in the field of signal transmission. The smaller the VSWR value, the better the RF connector. Thus, the VSWR of the RF connector 500 is better than that of the conventional RF connector 100. Therefore, the RF connector 500 can be used at higher-frequencies than of the conventional RF connector 100.

It should be noted that the above described embodiments are given as exemplary embodiments rather than limiting the invention. Those of ordinary skill in the art would appreciate and understand that modifications and variations may be made to the embodiments without departing from the spirit and scope of the invention. Such modifications and variations are considered to be within the scope of the invention and the appended claims. Further, the above described embodiments may combined in an combination with each other, and that these combinations fall within the spirit and scope of the invention. Further, in the claims, the indefinite article "a" or "an" preceding an element does not exclude the presence of a plurality of such elements.

What is claimed is:

1. A connector for surface mounting to a circuit substrate, comprising:

an insulator;

a center conductor mounted to the insulator and having an extending portion; and a shielding shell externally mounted on the insulator, and having a connecting portion complementary to a corresponding mating connector, and a mounting portion complementary to the circuit substrate, the mounting portion having a connector mounting body having a shielding portion with an internal surface surrounding the extending portion of the center conductor, a fluid communication well positioned between the extending portion and the internal surface of the shielding portion, and at least one opening formed in the connector mounting body, extending through the internal surface of the shielding portion and connecting to the fluid communication well on a first end, with an opposite second end terminating in outside space, such that the fluid communication well is in fluid communication with the outside space when the connector is soldered to the circuit substrate, and a plurality of solder legs formed on the connector mounting body.

2. The connector of claim 1, wherein the connector mounting body further comprises a groove positioned adjacent to the shielding portion.

3. The connector of claim 2, wherein an external surface of the shielding portion is defined by the groove.

4. The connector of claim 3, wherein the groove extends circumferentially around the shielding portion.

5. The connector of claim 4, wherein the groove is in fluid communication with the at least one opening.

6. The connector of claim 2, wherein the groove is in fluid communication with the at least one opening.

7. The connector of claim 6, wherein the groove has a width and depth of approximately 0.5 mm.

8. The connector of claim 1, wherein the connector mounting body is formed in an approximate square shape.

9. The connector of claim 8, wherein an internal surface diameter of the shielding portion is in a range of 2.80 to 3.10 mm.

10. The connector of claim 9, wherein the internal surface diameter of the shielding portion is approximately 3.00 mm.

11. The connector of claim 9, wherein an external diameter of the shielding portion is approximately 3.80 mm.

12. The connector of claim 8, wherein the connector mounting body has four openings.

13. The connector of claim 12, wherein the four openings are respectively positioned in an approximate middle of each edge of the square connector mounting body.

14. The connector of claim 1, wherein the internal surface of the shielding portion is annular.

15. The connector of claim 1, wherein the connector is an RF connector.

* * * * *